US011781837B1

(12) United States Patent
Wan

(10) Patent No.: US 11,781,837 B1
(45) Date of Patent: Oct. 10, 2023

(54) GUN LIGHT POSITIONED BY A SLIDING GUIDE RAIL

(71) Applicant: Shenzhen Xinyue Han Technology Co., Ltd., Shenzhen (CN)

(72) Inventor: Xiaobo Wan, Xiangxi Tujia and Miao Autonomous Prefecture (CN)

(73) Assignee: Shenzhen Xinyue Han Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/898,726

(22) Filed: Aug. 30, 2022

(30) Foreign Application Priority Data

Aug. 8, 2022 (CN) ..... 202222069650.4

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41G 11/003; F41G 1/35
USPC ..... 42/116
See application file for complete search history.

(56) References Cited

U.S. PATENT DOCUMENTS 7,987,623 B1 * 8/2011 Moody ..... F41G 11/003 42/71.01
2005/0115142 A1 * 6/2005 Kim ..... F41C 27/00 42/146
2006/0104064 A1 * 5/2006 Sharrah ..... H05K 1/147 362/396
2010/0205795 A1 * 8/2010 Moody ..... F41G 11/003 29/428
2011/0138673 A1 * 6/2011 Deros ..... F41G 11/003 42/90
2013/0312309 A1 * 11/2013 Rorick ..... F41G 11/003 42/114
2014/0047755 A1 * 2/2014 McClintock ..... F41G 11/003 42/90
2014/0204566 A1 * 7/2014 Kay ..... F41G 11/003 362/110
2019/0128470 A1 * 5/2019 Johnson, Sr. ..... F16M 11/16
2019/0331459 A1 * 10/2019 Johnson, Sr. ..... F41G 11/003
2019/0331460 A1 * 10/2019 Johnson, Sr. ..... F41G 11/003
2020/0084410 A1 * 3/2020 Sakiewicz ..... F41G 1/35
2020/0109916 A1 * 4/2020 Eichelberger ..... F41G 11/003
2022/0214142 A1 * 7/2022 Ding ..... F41G 11/003
2023/0064118 A1 * 3/2023 Stabler ..... F16B 2/12

* cited by examiner

*Primary Examiner* — Samir Abdosh
(74) *Attorney, Agent, or Firm* — Georgi Korobanov

(57) ABSTRACT

A gun light positioned by a sliding guide rail, comprising a light holder, a fixing plate is fixedly connected to left side of front part of the light holder, and a locking plate is slidably connected to the inside of the locking plate groove, the inside of the locking plate is threadedly connected with guide rail locking bolts by the screw holes, the front part of the light holder is provided with a positioning slider, the left part of the positioning slider is provided with a wave-shaped clamping slot, the rear part of the positioning slider is fixedly connected with a plurality of sliders, the front part of the light holder is provided with a screw hole, a limiting bolt is threadedly connected inside the screw hole, a groove is arranged inside the fixing plate, and a positioning steel ball is arranged inside the groove.

8 Claims, 4 Drawing Sheets

GUN LIGHT POSITIONED BY A SLIDING GUIDE RAIL

CROSS-REFERENCE TO RELATED APPLICATIONS

This application claims the benefit and priority of Chinese patent application No. 202222069650.4, filed on Aug. 8, 2022, disclosure of which is hereby incorporated by reference in its entirety.

TECHNICAL FIELD

The present application relates to the technical field of gun lights, and in particular, to a gun light positioned by a sliding guide rail.

BACKGROUND

Gun lights, also known as tactical lights, are lamps installed on firearms to assist the use of firearms at night. By installing the gun light on the guide rail of the firearm, the combat mode of holding the light in one hand and the gun in the other can be avoided at night, so that the gun can be held in both hands at night, which makes the firearm more stable.

After most of the gun lights are installed on the rails of the firearm, the position of the gun light on the firearm cannot be adjusted, which causes the hand to be blocked by the gun light when holding the gun, and thus makes it impossible to hold the gun tightly. At the same time, most of the gun lights have complicated structures, which are very inconvenient to install and use.

SUMMARY

The purpose of the present application is to propose a gun light positioned by a sliding guide rail in order to solve the shortcomings in the prior art.

In order to achieve the above object, the application adopts the following technical solutions: A gun light positioned by a sliding guide rail, comprising a light holder, wherein a fixing plate is fixedly connected to left part of front part of the light holder, and screw holes are respectively provided inside the fixing plate and the light holder, a guide rail locking bolt is threadedly connected to inside of the screw hole, and a locking plate groove is provided on right part of the light holder, a plurality of positioning holes are provided on left inner wall of the locking plate groove, and a locking plate is slidably connected inside the locking plate groove, a guide rail locking bolt is threadedly connected inside of the locking plate through the screw hole, a plurality of sliding grooves are fixedly connected to the front part of the light holder and the front part of the light holder is provided with a positioning slider, a left part of the positioning slider is provided with a wave-shaped clamping slot, and a plurality of sliders are fixedly connected to rear part of the positioning slider, the front part of the slider is fixedly connected with a plurality of fixing blocks, the front part of the light holder is provided with a screw hole, and a limiting bolt is threadedly connected inside the screw hole, a groove is arranged inside the fixing plate, and a positioning steel ball is arranged inside the groove.

As a further description of the above technical solutions:

A lower part of the light holder is provided with a switch button, and an upper part of the light holder is provided with a light head, and the switch button is electrically connected with the light head.

As a further description of the above technical solutions:

The sides of the fixing plate and the locking plate opposite to each other are respectively provided with a clamping slot, As a further description of the above technical solutions:

A front part of the limiting bolt is slidably connected to a middle part of the positioning slider.

As a further description of the above technical solutions:

The groove is arranged between a nut of the guide rail locking bolt and the wave-shaped clamping slot.

As a further description of the above technical solutions:

A plurality of positioning columns are fixedly connected to upper and lower sides of left part of the locking plate, and the plurality of positioning columns are arranged inside positioning holes.

As a further description of the above technical solutions:

The plurality of sliders are all slidably connected inside the sliding grooves.

As a further description of the above technical solutions:

A plurality of spring holes are arranged on left inner wall of the locking plate groove, and springs are arranged inside the plurality of spring holes.

The present application has the following beneficial effects:

1. In the present application, the tightness between the light holder and the positioning slider is adjusted by rotating the limiting bolt on the positioning slider, so that the light holder can slide relative to the positioning slider, and then the distance between the locking plate and the fixing plate can be adjusted by rotating the guide rail locking bolt, and then the clamping slots on the fixing plate and the locking plate are snapped into the slide rail at the lower part of the gun barrel, so that the gun light can be easily installed on the gun body, and tighten the guide rail locking bolt to fix the gun light on the gun body, so that the gun light can be conveniently and quickly installed on the gun body, and it is extremely convenient to use.
2. In the present application, by adjusting the tightness of the guide rail locking bolt, the distance between the nut of the guide rail locking bolt and the groove in the fixing plate is increased, so that the positioning steel ball can roll back and forth in the groove, and disengage from the inside of the wave-shaped clamping slot. At the same time, hold the light holder by hand and turn the light holder, so that the light holder can slide relative to the positioning slider, so that the position of the light holder on the positioning slider can be adjusted, and then the position of the gun light on the gun body can be adjusted. At the same time, tighten the guide rail locking bolt, the nut of the bolt will squeeze the positioning steel ball to the right, so that it moves along the groove to the inside of the wave-shaped clamping slot, and then the positioning steel ball is firmly fixed inside of the wave-shaped clamping slot by the nut of the guide rail locking bolt, so that the positioning slider and the light holder are fixed, so that the light holder will not slide relative to the positioning slider, and it is fixed on the gun body. This enables the gun light to slide along the guide rail of the gun body and locate it to the required position, so as to avoid the hand not being obstructed by the gun light when holding the gun.

Reference signs:

1. Light head; 2. Light holder; 3. Guide rail locking bolt; 4. Sliding groove; 5. Switch button; 6. Clamping slot; 7. Locking plate; 8. Limiting bolt; 9. Positioning slider; 10. Fixing plate; 11. Slider; 12, wave-shaped clamping slot; 13. Screw hole; 14. Locking plate groove; 15. Spring; 16. Groove; 17. Positioning steel ball; 18. Screw hole; 19. Fixed Block; 20. Spring hole; 21. Positioning column; 22. Positioning hole.

DETAILED DESCRIPTION

The technical solutions in the embodiments of the present application will be clearly and completely described below with reference to the drawings in the embodiments of the present application. Obviously, the described embodiments are only a part of the embodiments of the present application, but not all of the embodiments. Based on the embodiments in the present application, all other embodiments obtained by those of ordinary skill in the art without creative efforts shall fall within the protection scope of the present application.

Figure 1:
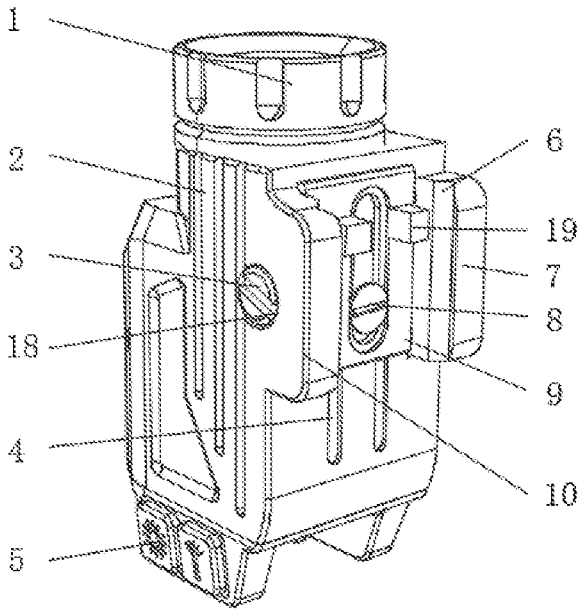
FIG. 1 is a front perspective view of a gun light positioned by a sliding guide rail proposed according to the present application.
Figure 2:
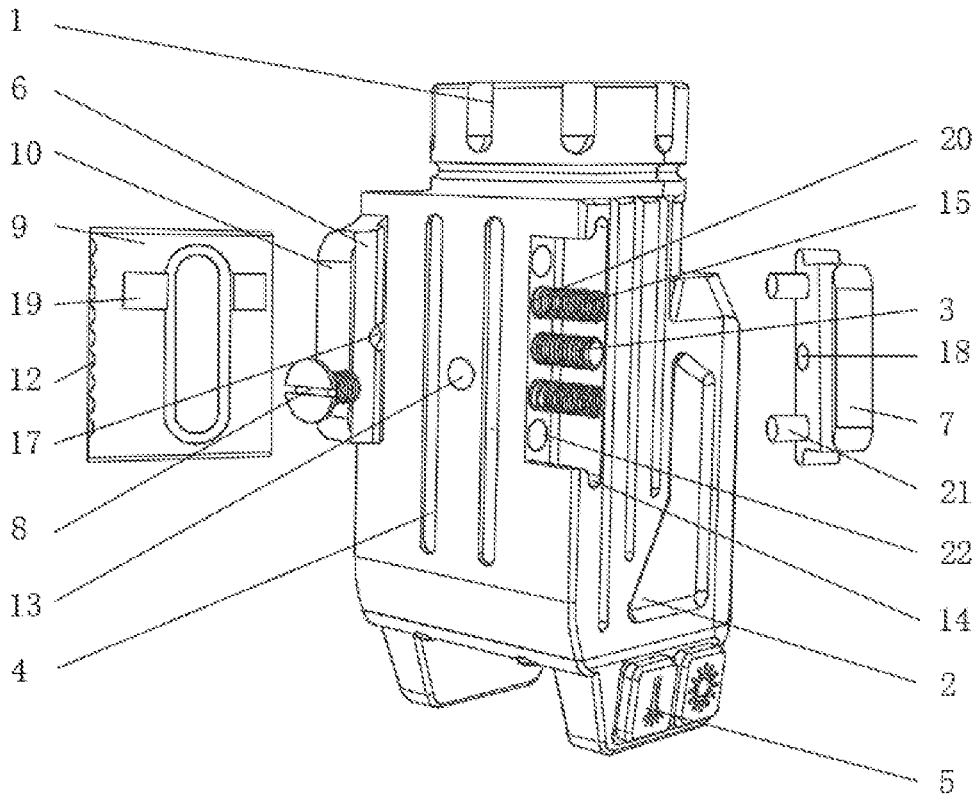
FIG. 2 is an exploded view of a gun light positioned by a sliding guide rail according to the present application.
Figure 3:
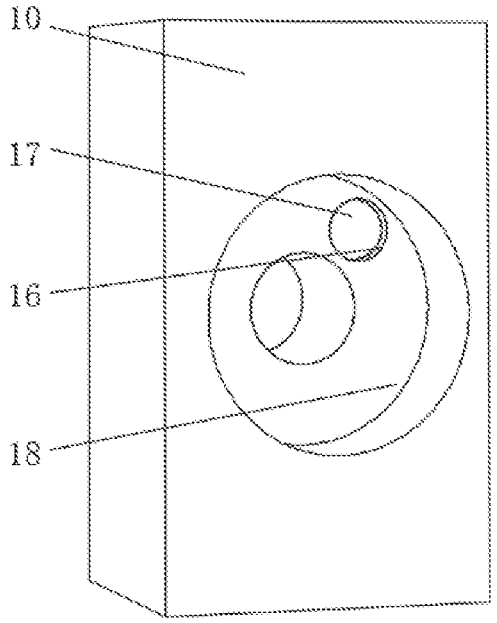
FIG. 3 is a schematic structural view of the groove of a gun light positioned by a sliding guide rail according to the present application.
Figure 4:
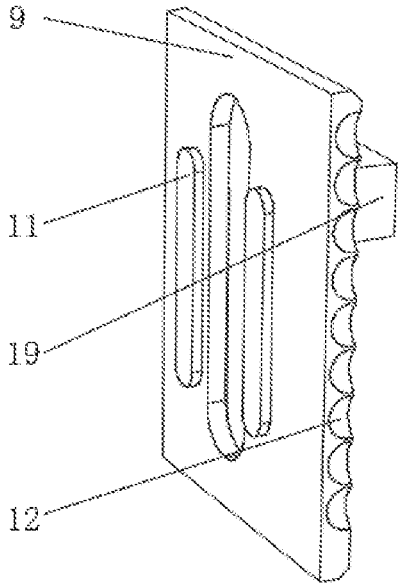
FIG. 4 is a side view of a positioning slider of a gun light positioned by a sliding guide rail according to the present application.

Referring FIGS. 1-4, an embodiment provided in the present application: a gun light positioned by a sliding guide rail, comprising a light holder 2, wherein a fixing plate 10 is fixedly connected to left part of front part of the light holder 2, and screw holes 18 are respectively provided inside the fixing plate 10 and the light holder 2, a guide rail locking bolt 3 is threadedly connected to inside of the screw hole 18. The tightness between the light holder 2 and the positioning slider is adjusted by rotating the limiting bolt 18 on the positioning slider 9, so that the light holder 2 can. slide relative to the positioning slider 9, and then the distance between the locking plate 7 and the fixing plate 10 can be adjusted by rotating the guide rail locking bolt 3, and then the clamping slots 6 on the fixing plate 10 and the locking plate 7 are snapped into the slide rail at the lower part of the gun barrel, so that the gun light can be easily installed on the gun body, and tighten the guide rail locking bolt 3 to fix the gun light on the gun body, so that the gun light can be conveniently and quickly installed on the gun body, and it is extremely convenient to use. A locking plate groove 14 is provided on right part of the light holder 2, a plurality of positioning holes 22 are provided on left inner wall of the locking plate groove 14. The positioning holes 22 and the positioning columns 21 on the locking plate 7 can position the locking plate 7, so that the locking plate 7 can be easily installed on the light holder 2. The locking plate 7 is slidably connected inside the locking plate groove 14, the guide rail locking bolt 3 is threadedly connected inside of the locking plate 7 through the screw hole 18. By rotating the guide rail locking bolt 3, the locking plate 7 can be pushed to the right, so that the distance between the locking plate 7 and the fixing plate 10 is increased, so that the clamping slot 6 can be smoothly inserted into the slide rail of the gun body. A plurality of sliding grooves 4 are fixedly connected to the front part of the light holder 2. The slider 11 on the fixing slider 9 slides flexibly in the sliding grooves 4, so that the light holder 2 can slide relative to the fixing slider 9, thereby adjusting the position of the light holder 2 on the gun body. The front part of the light holder 2 is provided with the positioning slider 9, a left part of the positioning slider 9 is provided with a wave-shaped clamping slot 12. The wave-shaped slot 12 is a quarter-spherical slot, which can clamp the positioning steel ball 17 into the wave-shaped slot 12 when the guide rail locking bolt 3 is tightened, and then fix the slider 9 and the light holder 2. A plurality of sliders 11 are fixedly connected to rear part of the positioning slider 9, the front part of the slider 9 is fixedly connected with a plurality of fixing blocks 19. When the lamp holder 2 is installed on the gun body, the fixed block 9 can be stuck in the groove on the gun body slide rail, so that the positioning slider 9 will not slide relative to the gun body. The front part of the light holder 2 is provided with a screw hole 13, and a limiting bolt 8 is threadedly connected inside the screw hole 13, a groove 16 is arranged inside the fixing plate 10, and a positioning steel ball 17 is arranged inside the groove 16. By adjusting the tightness of the guide rail locking bolt 3, the distance between the nut of the guide rail locking bolt 3 and the groove 16 in the fixing plate 10 is increased, so that the positioning steel ball 17 can roll back and forth in the groove 16, and disengage from the inside of the wave-shaped clamping slot 12. At the same time, hold the light holder 2 by hand and turn the light holder 2, so that the light holder 2 can slide relative to the positioning slider 9, so that the position of the light holder 2 on the positioning slider 9 can be adjusted, and then the position of the gun light on the gun body can be adjusted. At the same time, tighten the guide rail locking bolt 3, the nut of the bolt will squeeze the positioning steel ball 17 to the right, so that it moves along the groove to the inside of the wave-shaped clamping slot 12, and then the positioning steel ball 17 is firmly fixed inside of the wave-shaped clamping slot 12 by the nut of the guide rail locking bolt 3, so that the positioning slider 9 and the light holder 2 are fixed, so that the light holder 2 will not slide relative to the positioning slider 9, and it is fixed on the gun body. This enables the gun light to slide along the guide rail of the gun body and locate it to the required position, so as to avoid the hand not being obstructed by the gun light when holding the gun.

A lower part of the light holder 2 is provided with a switch button 5, and an upper part of the light holder 2 is provided with a light head 1, and the switch button 5 is electrically connected with the light head 1. By pressing the switch button 5, the light head 1 on the light bolder 2 can be turned on for lighting. The sides of the fixing plate 10 and the locking plate 7 opposite to each other are respectively provided with the clamping slot 6. The clamping slot 6 can be stuck on the slide rail at the barrel of the firearm, so that the gun light can be installed on the gun body. A front part of the limiting bolt 8 is slidably connected to a middle part of the positioning slider 9. By controlling the tightness between the limiting bolt 8 and the positioning slider 9, the limiting bolt 8 can slide in the hole in the positioning slider 9, and at the same time, the sliding distance of the light holder 2 can be limited within the hole in the middle of the positioning slider 9. The groove 16 is arranged between the nut of the guide rail locking bolt 3 and the wave-shaped slots 12. Tighten the guide rail locking bolt 3, and the nut of the bolt will squeeze the positioning steel bail 17 inside the groove 16 to the right, so that it moves along the groove 16 to the inside of the wave-shaped slot 12 until the nut is in close contact with the positioning steel ball 17. The positioning steel ball 17 is closely attached to the inner wall of the wave-shaped slot 12, so that the light holder 2 will not slide relative to the positioning slider 9, and is fixed on the gun body. A plurality of positioning columns 21 are fixedly connected to upper and lower sides of left part of the locking plate 7, and the plurality of positioning columns 21 are arranged inside positioning holes 22. The positioning holes 22 and the positioning columns 21 on the locking plate 7 can position the locking plate 7, so that the locking plate 7 can be easily installed on the light holder 2. The plurality of sliders 11 are all slidably connected inside the sliding grooves 4. The slider 11 and the sliding groove 4 can limit the moving distance of the light holder 2 to prevent it from detaching from the gun body. A plurality of spring holes 20 are arranged on left inner wall of the locking plate groove 14, and springs 15 are arranged inside the plurality of spring holes 20. The spring 15 will hold the locking plate 7, so that an opposite force will be generated between the light holder 2 and the locking plate 7, so that when the guide rail locking bolt 3 is adjusted, the positioning steel ball 17 will not fall off from the groove 16.

Working Principle:

The tightness between the light holder 2 and the positioning slider is adjusted by rotating the limiting bolt 18 on the positioning slider 9, so that the light holder 2 can slide relative to the positioning slider 9, and then the distance between the locking plate 7 and the fixing plate 10 can be adjusted by rotating the guide rail locking bolt 3, and then the clamping slots 6 on the fixing plate 10 and the locking plate 7 are snapped into the slide rail at the lower part of the gun barrel. The fixing block 19 on the fixing slider 9 will be stuck in the groove on the sliding rail, so that the fixing slider 9 will not move on the sliding rail of the gun body, and then pull the light holder 2 to move along the positioning slider 9, and then adjust the position of the gun light on the gun body. At the same time, tighten the guide rail locking bolt 3, the nut of the bolt will squeeze the positioning steel ball 17 to the right, so that it moves along the groove 16 to the inside of the wave-shaped slot 12, until the nut is close to the positioning steel ball 17. The positioning steel ball 17 is closely attached to the inner wall of the wave-shaped slot 12, so that the light holder 2 does not slide relative to the positioning slider 9, and is fixed on the gun body, so that the gun light can be easily installed on the gun body, and the gun position of the gun light on the gun body can be adjusted.

Finally, it should be noted that the above are only the preferred embodiments of the present application, and are not intended to limit the present application. Although the present invention has been described in detail with reference to the foregoing embodiments, those skilled in the art can still modify the technical solutions described in the foregoing embodiments, or perform equivalent replacements for some of the technical features. Any modification, equivalent replacement, improvement, etc. made within the spirit and principle of the present invention shall be included in the protection scope of the present invention.

What is claimed is:

1. A gun light positioned by a sliding guide rail, comprising alight holder (2), wherein a fixing plate (10) is fixedly connected to a left part of a front part of the light holder (2), and screw holes (18) are respectively provided inside the fixing plate (10) and the light holder (2), a guide rail locking bolt (3) is threadedly connected to inside of the screw hole (18), and a locking plate groove (14) is provided on a right part of the light holder (2), a plurality of positioning holes (22) are provided on a left inner wall of the locking plate groove (14), and a locking plate (7) is slidably connected inside the locking plate groove (14), the guiderail locking bolt (3) is threadedly connected inside of the locking plate (7) through the screw hole (18), a plurality of sliding grooves (4) are fixedly connected to the front part of the light holder (2), and the front part of the light holder (2) is provided with a positioning slider (9), a left part of the positioning slider (9) is provided with a wave-shaped clamping slot (12), and a plurality of sliders (11) are fixedly connected to a rear part of the positioning slider (9), a front part of the positioning slider (9) is fixedly connected with a plurality of fixing blocks (19), the front part of the light holder (2) is provided with a screw hole (13), and a limiting bolt (8) is threadedly connected inside the screw hole (13), a groove (16) is arranged inside the fixing plate (10), and a positioning steel ball (17) is arranged inside the groove (16).

2. The gun light positioned by a sliding guide rail according to claim 1, wherein a lower part of the light holder (2) is provided with a switch button (5), and an upper part of the light holder (2) is provided with a light head (1), and the switch button (5) is electrically connected with the light head (1).

3. The gun light positioned by a sliding guide rail. according to claim 1, wherein the sides of the fixing plate (10) and the locking plate (7) opposite to each other are respectively provided with a clamping slot (6).

4. The gun light positioned by a sliding guide rail according to claim 1, wherein a front part of the limiting bolt (8) is slidably connected to a middle part of the positioning slider (9).

5. The gun light positioned by a sliding guide rail according to claim 1, wherein the groove (16) is arranged between a nut of the guide rail. locking bolt (3) and the wave-shaped clamping slot (12).

6. The gun light positioned by a sliding guide rail according to claim 1, wherein a plurality of positioning columns (21) are fixedly connected to upper and lower sides of left part of the locking plate (7), and the plurality of positioning columns (21) are arranged inside positioning holes (22).

7. The gun light positioned by a sliding guide rail according to claim 1, wherein the plurality of sliders (11) are all slidably connected inside the sliding grooves (4).

8. The gun light positioned by a sliding guide rail according to claim 1, wherein a plurality of spring holes (20) are arranged on a left inner wall of the locking plate groove (14), and springs (15) are arranged inside the plurality of spring holes (20).

* * * * *